United States Patent [19]

Gaubert

[11] 4,416,395

[45] Nov. 22, 1983

[54] BULK LIQUID CONTAINER, TAP AND TAP ASSEMBLY THEREFORE

[76] Inventor: Rene J. M. Gaubert, 4219 Oakmore Rd., Oakland, Calif. 94602

[21] Appl. No.: 305,922

[22] Filed: Sep. 28, 1981

Related U.S. Application Data

[63] Continuation-in-part of Ser. No. 146,762, May 5, 1980, Pat. No. 4,314,654, which is a continuation-in-part of Ser. No. 116,475, Jan. 9, 1980, abandoned.

[51] Int. Cl.[3] ..... B67B 7/26

[52] U.S. Cl. ..... 222/83; 222/105; 222/536; 222/510; 222/534; 285/158

[58] Field of Search ..... 222/81, 82, 83, 83.5, 222/87, 88, 105, 182, 183, 501, 509, 510, 533, 534, 536, 538, 541; 215/11 E; 285/158, 192, 423

[56] References Cited

U.S. PATENT DOCUMENTS

| | | | |
|---|---|---|---|
| 1,306,376 | 6/1919 | Hall | 222/510 |
| 1,324,206 | 12/1919 | Nickell | 222/83 |
| 2,169,779 | 8/1939 | Loewe | 222/510 |
| 2,373,373 | 4/1945 | Berg | 222/83 |
| 2,574,989 | 11/1951 | Waite . | |
| 3,137,415 | 6/1964 | Faunce . | |
| 3,206,075 | 9/1965 | Scholie . | |
| 3,642,172 | 2/1972 | Malpan . | |
| 3,651,973 | 3/1972 | Yamauchi | 215/11 E |
| 3,930,280 | 1/1976 | McGowen . | |
| 4,146,153 | 3/1979 | Bailen | 222/83 |
| 4,219,138 | 8/1980 | Hazard | 222/534 |
| 4,247,020 | 1/1981 | Desjardins . | |

FOREIGN PATENT DOCUMENTS 35315 10/1979 Australia .

*Primary Examiner*—H. Grant Skaggs
*Attorney, Agent, or Firm*—Flehr, Hohbach, Test, Albritton & Herbert

[57] ABSTRACT

A bulk liquid (e.g. wine, etc.) container of the type having an outer carton and an inner flexible pouch or bag, and means including a tap for dispensing the liquids. The tap is normally disposed in a separate housing that is attached to one wall outwardly to dispensing position, whereby a seal is established between one end of the tap and a fitting on the pouch, a sealing membrane of the pouch is disrupted and finally a secondary seal is established. Also a tap construction having means for establishing the second seal and a housing tap assembly.

8 Claims, 16 Drawing Figures

BULK LIQUID CONTAINER, TAP AND TAP ASSEMBLY THEREFORE

This application is a continuation-in-part of copending application Ser. No. 146,762 filed May 5, 1980 entitled BULK LIQUID CONTAINER, which in turn is a continuation-in-part of application Ser. No. 116,465, filed Jan. 9, 1980, now abandoned, for BULK LIQID CONTAINER and which application has issued as U.S. Pat. No. 4,314,654, dated Feb. 9, 1982.

This invention relates generally to bulk containers for the marketing of various liquids such as wine or milk. It also relates to taps and tap assemblies used with such containers.

Liquids such as wine are presently being marketed in cartons made of fiber board and lined with a pourch or bag made of flexible materials, such as plastic or metal foil. In some instances a fitting, which is generally made of plastic material, is bonded to one wall of the pouch and provides an opening through which liquid is introduced at the time the pouch is filled. A lower wall portion of the pouch is provided with a dispensing fitting, which provides an opening through which liquid can be dispensed. In some instances one fitting serves to permit both filling and dispensing of the liquid. In one type of package the sealing means for the dispensing fitting is a membrane that is pierced to disrupt the same. Preparatory to dispensing liquid the dispensing fitting is removed from the carton and secured to one side wall where it is accessible from the exterior.

When it is desired to dispense liquid the operator forces the pointed end of a tap through the fitting and against the sealing membrane, thus piercing and disrupting the same, and the tap is coupled to the fitting whereby when the valve at the exterior end of the tap is opened, liquid flows from the pouch through the fitting and the tap.

An improved bulk liquid container, tap and tap assembly, and disclosed in said U.S. Pat. No. 4,314,654 dated Feb. 9, 1882. The tap in that instance is normally disposed in a housing that is attached to one side wall of the carton. When a portion of the carton is removed to expose the tap, the tap is swung outwardly to a dispensing position, and during this movement the inner end of the tap engages and disrupts the sealing membrane of the fitting, and the fitting and tap are coupled together.

In both of the embodiments described above an effective seal must be established between the fitting and that end of the tap which is introduced into the fitting, to avoid any liquid leakage during the period of time that liquid is being dispensed. In certain prior constructions when the tap is thrust into the dispensing fitting, the sealing membrane may be pierced and disrupted before the sealing means has been effectively established. Thus some liquid leakage may occur at the time the tap is installed. Such a seal may not be completely reliable, particularly where the tap is mounted upon a separate housing and is swung to a position in which one end of the tap enters the fitting and disrupts the seal.

Taps of the type that have been used with bulk liquid containers have employed various types of manually operated valves that are opened and closed manually. Certain problems are involved in providing a dispensing valve which is completely satisfactory. For example there should be positive shutoff when the valve is moved to closed position, with an absence or minimum amount of drippage after closing. In addition any liquid within the body of the valve should be completely sealed from contact with the atmosphere, since contact with air causes some oxidation with resulting deterioration in flavor. In addition to the foregoing a valve should be relatively simple to construct and operate.

In general it is the object of the present invention to provide an improved bulk liquid container, tap and tap construction therefore, which provides effective sealing means between the dispensing fitting and the adjacent end portion of the tap body. More specifically the present improved construction provides sealing means which establishes seals on two annular areas between the fitting and the adjacent end portion of the tap body. One seal is first established just before the membrane is distrupted and this seal is maintained as the tap is moved to its final position. A second dry seal is established as the tap is moved to its final position relative to the fitting.

Another object is to provide a relatively simple manually operated dispensing valve for the tap, which is characterized by the absence of drippage after closing, and by the absence of exposure of liquid in the valve to the atmosphere after a dispensing operation.

Another object is to provide a valve for a dispensing tap which is relatively simple in construction, easy to manipulate, and can be easily manufactured from moldable plastic materials.

In general the present invention consists of a tap assembly for dispensing liquid from a pouch which has a dispensing fitting attached to one wall, the fitting having a sealing membrane. The tap consists of a body having an end portion adapted to be projected into the opening of the fitting to disrupt the membrane. Sealing means is provided between the fitting and the tap, which includes an annualr socket carried by the end portion of the tap and dimensioneed to embrace the exterior end of the fitting. In the preferred embodiment the sealing means provides two seals between the tap body and the fitting. At the time the tap is initially introduced into the fitting, one seal is established just before the membrane is disrupted, and thereafter as the tap is moved to its final position another secondary seal is established. The tap is carried by a housing that is secured to one wall of the carton, the arrangement being such that the tap can be swung from an out-of-the-way position within the housing, to a dispensing position extending from the housing. During such swinging movement of the tap to dispensing position, the end of the tap body is projected into the fitting, seal is established between the tap and the fitting, the membrane is then disrupted, and thereafter the first mentioned seal is established. As a futher feature the tap is provided with a novel dispensing valve which is manually operated to dispense liquid from the pouch, the construction being such that it avoids liquid drippage after the valve is closed, and avoids any contact of the atmosphere with wine within the valve body between dispensing operations. The valve is of simple construction which can be readily manufactured and assembled. The invention also incorporates a complete bulk liquid container or package, which includes the foregoing tap and tap assembly.

Additional objects and features of the invention will appear from the following description in which the preferred embodiment has been set forth in detail in conjunction with the accompanying drawing.

REFERRING TO THE DRAWING

Figures 1, 2, 3:
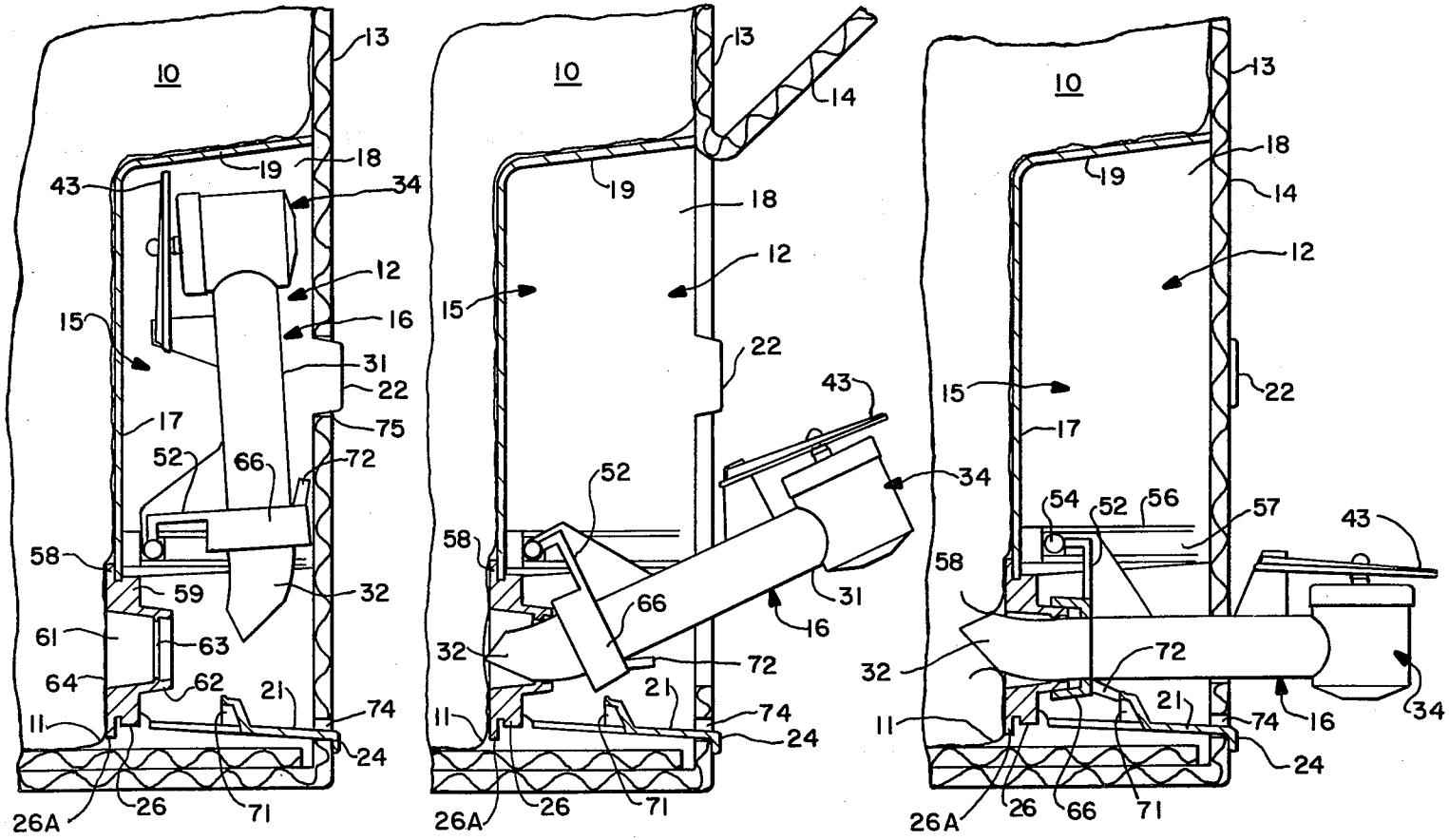
FIG. 1 is a side elevational view in section illustrating a portion of a bulk container incorporating the present invention.
FIG. 2 is similar to FIG. 1, but shows the tap in a position intermediate its out-of-the-way position, and the dispensing position.
FIG. 3 is similar to FIG. 1, but shows the tap in dispensing position.

The assembly illustrated in FIG. 1 consists of an outer carton 10 generally made of relatively stiff material, such as corrugated fiber board, which has a shape and size depending upon the desired capacity. Within the outer carton there is a pouch 11 made of flexible material, such as laminated polyethelene, flexible metallic foil or a laminate of plastic film and foil. Normally the pouch is filled with liquid such as wine. Mounted within the carton there is a dispensing assembly unit 12 which is secured to the adjacent carton wall 13 and which is adapted to be connected to a dispensing fitting on an adjacent portion of the bag. The tap part of the assembly unit is behind a readily removable portion 14 of the carton wall.

The assembly unit 12 preferably is made entirely of suitable plastic material, and consists of a housing 15 which serves to house and carry the tap 16. The housing (FIGS. 1, 6 and 7) consists of connected back, side, top and bottom walls 17, 18, 19 and 21. Outwardly extending tabs 22 are formed on the side walls 18, and these walls bulge outwardly at the lower end of the housing. The bottom wall 21 has a downwardly extending tab 24. The material and construction of the housing is such that the walls may be sprung toward each other during installation of the carton. It is desirable that at least the back wall 17 of the housing be made of material which is light transparent or translucent.

Figure 7:
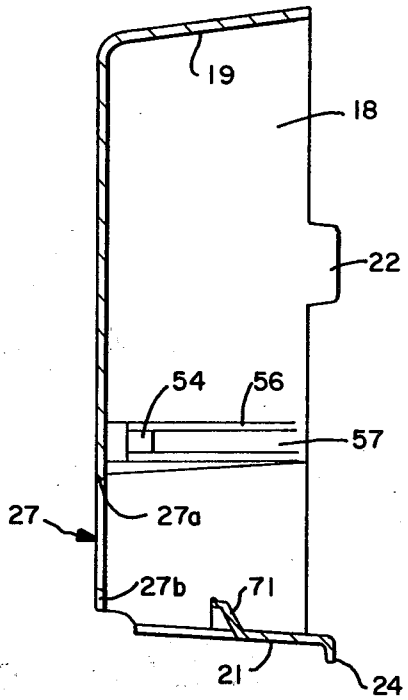
FIG. 7 is a cross-sectional view taken along the line 77 of FIG. 6.
Figure 6:
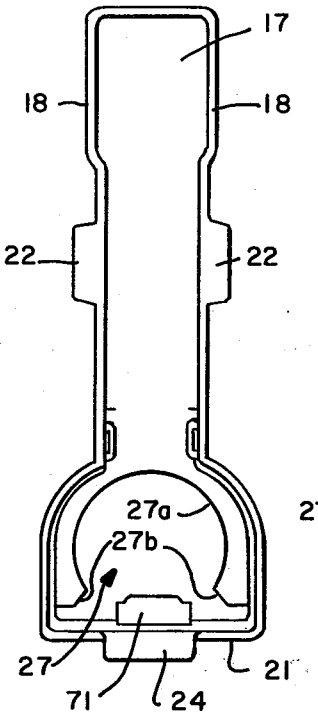
FIG. 6 is a front view of the housing for accommodating the tap.
Figure 5:
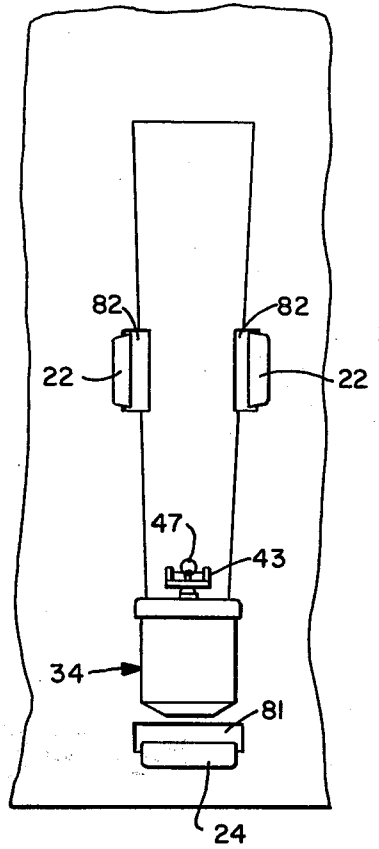
FIG. 5 is a view like FIG. 4, but showing a part of the carton side wall stripped away to make the tap accessible.
Figure 4:
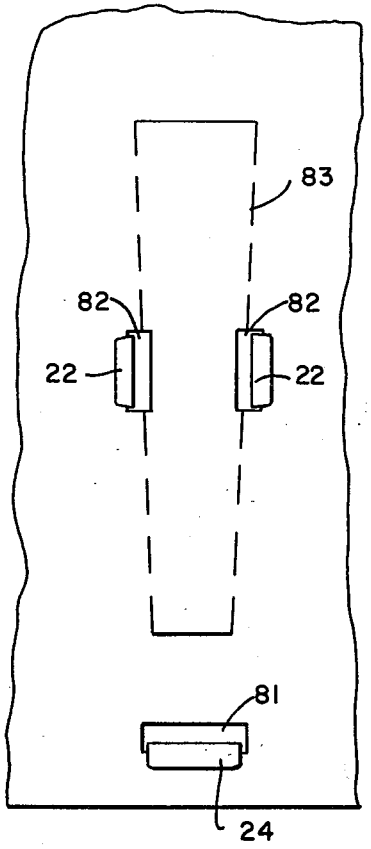
FIG. 4 is a view looking toward one side wall of the carton behind which the tap assembly is mounted.
Figure 8:
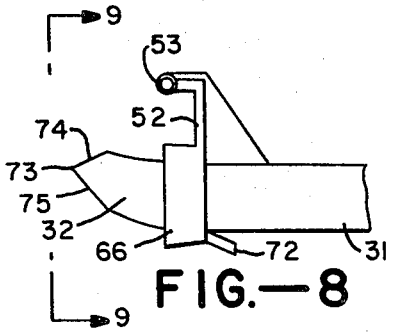
FIG. 8 is a detail view looking toward one side of that part of the tap which pierces and forms a seal with the plastic fitting.
Figure 9:
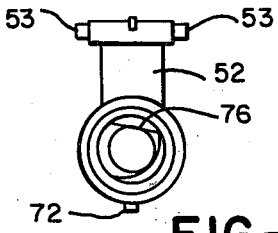
FIG. 9 is a view looking toward the left-hand end of FIG. 8, as indicated by line 9—9 of FIG. 8.

As shown in FIGS. 1, 6 and 7, the housing is preferably provided with means for loosely connecting the same to the pouch fitting 26. This fitting is made of suitable plastic material. It is annular and has an opening through the same. The lower portion of the back wall 17 of the housing is formed with an inverted U-shaped slot 27 or opening (FIGS. 6 and 7). This slot is open at its lower end for receiving the fitting 26. Its upper arcuate edge 27*a* has a diameter slightly greater than the annular groove 26*a* of the fitting, and extends over an arc greater than 180° (e.g. 240°). The lower edges 27*b* are preferably downwardly divergent.

The preferred construction of the tap 16 is shown in FIGS. 1–4, 8–10. It consists of a tube-like body 31 which has a pointed end portion 32 that serves to pierce the sealing membrane of the fitting 26. The passageway 33 of the body opens through the pointed end portion 32. At the other end of the body there is a valve 34 that is manually operated to dispense liquid. The preferred valve construction is illustrated in FIGS. 11–16. It consists of a hollow valve body 36, which may be cylindrical, and which has one side wall secured to and communicating with the adjacent end of the tubular body 31. The lower end of the valve body is partially closed by the annular wall tion 37, which is formed to provide the centrally valve seat 38. An annular valve member 39 is disposed within the valve body and is mounted upon the lower end of the valve stem 41. The upper end of the valve body is sealed by the closure 42 which has a central opening for slidably receiving the stem 41. The fit between the stem and the closure 42 is such as to provide a seal. In this connection the closure 42 may be provided with an annular seal portion 42*a* which has some resiliency and is stressed sufficiently to maintain sealing contact with the same.

The manually operating means for the valve stem 41 consists of a strip 43 which may be made of suitable plastic material that is relatively stiff. One end of this strip (FIG. 12) is provided with a slot 44. Integral rounded ridges 45 are formed on the upper and lower sides of the strip at the closed end of the slot. The intermediate portion of the strip is provided with a keyhole-shaped slot 44 which has a configuration such that it can be engaged with the rounded head portion 47 on the upper end of the stem 41.

Figure 11:
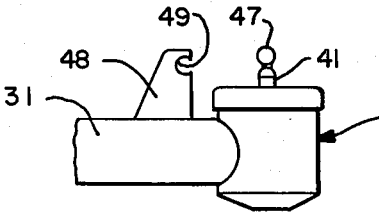
FIG. 11 is a detail looking toward one side of the dispensing valve forming a part of the tap, with the operating lever removed.
Figure 12:
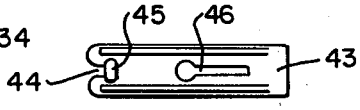
FIG. 12 is a planned view showing the operating lever detached from FIG. 11.
Figure 13:
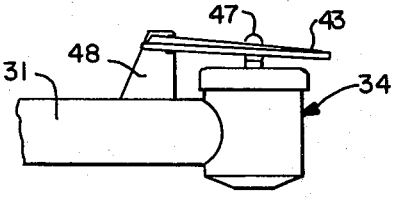
FIG. 13 is a side view of the complete dispensing valve.
Figure 14:
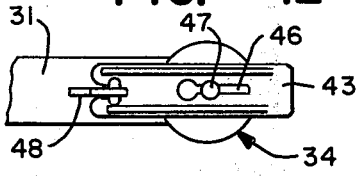
FIG. 14 is a plan view of the assembly shown in FIG. 13.
Figure 15:
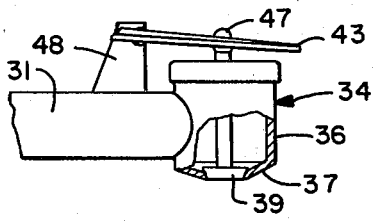
FIG. 15 is a side view of the completed dispensing valve with a partial cross-section showing the valve in the closed position.

The tubular body 31 is provided with an upstanding member 48, one edge of which is notched as indicated at 49. When strip 43 is assembled with the valve as shown in FIG. 11, the assembly appears as shown in FIGS. 13, 14 and 15. To complete this assembly the strip 43 is first engaged with the rounded head portion 47 of the valve stem, by passing the head portion through the enlarged end of the keyhole slot 46. The slotted end of the strip 43 is positioned with the slot 44 aligned with the notch 49, and the the strip is moved toward the left as viewed in FIG. 13, thereby causing the ridges 45 to snap into the notch 49, and the head portion 47 of the stem to be effectively attached to the strip 43 intermediate the ends of the slot 46 (see FIG. 14). It is intended for this to be a factory-made assembly, and that the strip 43 should remain as a permanent part of the assemby, in the hands of the consumer.

Figure 16:
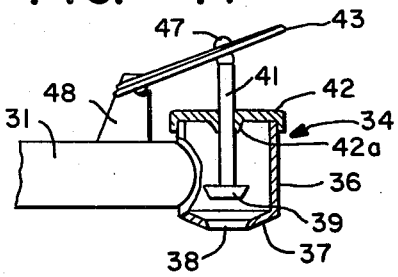
FIG. 16 is a side view of the completed dispensing valve with a partial cross-section showing the valve in the open position.

The complete valve assembly, as shown in FIGS. 13–16, is operated by manually manipulating the extended end portion of the strip 43, namely that end portion at the right hand side of FIG. 16. Closed portion of the valve member 39 upon the seat 38 is shown in FIG. 15. The attachments of the strip to the valve stem, and to the member 48, are such that they not only retain the strip operatively connected, but in addition they function as fulcrums to permit rocking movement of the strip.

A feature of the valve described above is that after it is closed following a liquid dispensing operation, substantially no liquid drippage occurs. Also the interior of the valve body 36 is effectively sealed with respect to the surrounding atmosphere, and therefore the liquid retained within the valve body is not exposed to the atmosphere and thereby subject to oxidation or contamination.

The tap 16 is pivotably connected to the housing whereby it can be swung from the position shown in FIG. 1 to that shown in FIG. 3. For this purpose an L-shaped arm 52 is secured to the body 31, and is provided with integral pivot pins 53. When assembled within the housing 15 the pivot pins are journalled within the openings 54 in the housing side walls. To facilitate such assembly the side walls are shown provided with inner ribs 56 which are parallel and spaced, and which provide guideways 57 through which the pins may pass as the lever is moved toward the back wall of the housing to cause the pins to snap within the holes 54. During this assembly operation the side walls of the housing are sprung apart a sufficient amount to permit the pins to pass through the guideways 57.

The fitting 26 is secured to one wall of the inner flexible bag 11, before the bag is filled with liquid. In the form illustrated it has an annular flange 58, an annular body 59 which has an opening 61 through the same, and an annular portion 62 which extends within the housing 15 and preferably is tapered as viewed in FIG. 10. The material from which the fitting is made, and the dimensions of the annular extension 62, are such that the extension is somewhat pliable. The inner surface of the extension 62 is provided with an annular rounded bead 63. The fitting is mounted on the adjacent wall of the pouch 11 as by a heat sealing operation. The portion 64 of the pouch wall provides a sealing membrane extending across the opening 61 of the fitting. The hinged attachment of the tap to the housing, and the relatively positioning of the tap with respect to the fitting 26, is such that when the tap is initially swung downwardly to the position shown in FIG. 2, the end portion 32 is caused to enter the fitting opening 61, and to be in contact with or adjacent to the membrane 64. At the same time the end portion 32 of the tap body is brought into sealing engagement with the rounded bead 63, with some radial expansion of the bead, thus establishing a seal before further movement of the tap causes the membrane 64 to be disrupted. Continued movement of the tap to the position shown in FIG. 3, causes the end portion 32 to pierce and disrupt the membrane 64, thus conditioning the tap for dispensing liquid.

While the rounded bead 63 on the annular fitting extension 62 provides an effective initial seal between the fitting and the end portion 32 of the tap body, over an extended period of use during which the tap remains in the position shown in FIG. 3, radial stretching applied to the extension 62 when the tap is inserted to the position shown in FIG. 3, may weaken to the extent of permitting some leakage to occur. To ensure against such leakage secondary sealing means is provided which not only provides a secondary seal between the fitting and the tap body, but which in addition aids in retaining the bead 63 in tight engagement with the adjacent surface of the tap body. Thus an annular member 66 is secured to the tap body and is dimensioned to form a tapered socket which accommodates the adjacent end of the portion 62 of the fitting. The material from which member 66 is made is likewise somewhat pliable or stretchable, and the dimensions are such that when it is urged to the final position shown in FIG. 3, the outer annular wall of member 66 is radially expanded and tensioned whereby it applies radially directed forces against the annular portion 62, with consequent force being applied to urge and retain the bead 63 in tight sealing engagement with the adjacent surface of the tap body. In conjunction with force being applied radially to urge the bead 63 against the tap body, the member 66 of itself forms a secondary seal with respect to the extension 62.

Means is provided for locking the tap in its dispensing position shown in FIG. 3. Thus an abutment 71 is mounted upon the bottom wall 21 of the housing 12. It cooperates with a spring tongue 72 which functions as a latch. The tongue may be an integral part of the structure which includes the L-shaped arm 52 and the socket member 66. In other words these parts may be moulded integrally. When the tap is swung from the position shown in FIG. 2 to that of FIG. 3, the tongue 72 is sprung toward the body of the tap, thus permitting it to pass over the top of the abutment 71, after which it snaps to the locking position shown in FIG. 3.

Figure 10:
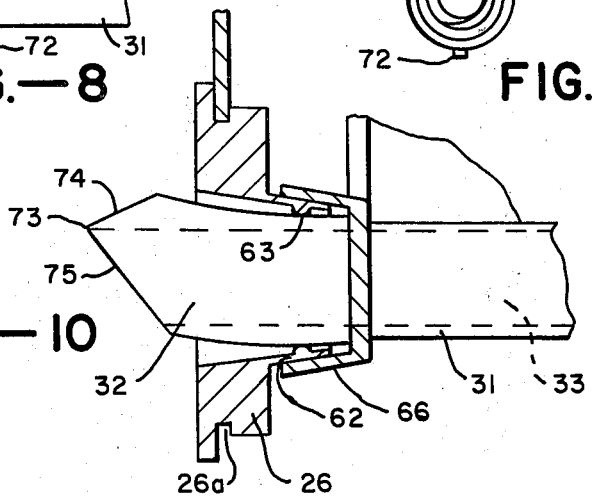
FIG. 10 is an enlarged detail in section showing the sealing means between one end of the tap body and the annular fitting.

The piecrcing end of the tap portion 32 may be similar to what is described in my copending application Ser. No. 146,762, now U.S. Pat. No. 4,314,654. The configuration of the end of the tap portion 32 is such as to form a relatively sharp piercing point 73 which initiates piercing of the sealing membrane. This point is formed by shaping the end of the tap to the configuration shown in FIGS. 8, 9 and 10. The shaping includes the areas 74 and 75 which converge along the cutting edge 76. The areas 74 and 75 are co-incident with planes that are inclined to the axis of the passageway 33 through the tap body. It will be noted that the end portion 32 of the tap body is formed somewhat arcuate as illustrated in FIG. 10, thereby facilitating its entry into the fitting 26 as it is swung to final dispensing position. Also that part oof the end portion 32 adjacent to the areas 74 and 75, may be of slightly reduced diameter.

Installation of the complete assembly unit 15 within the outer carton 10 can be carried out as follows. The fitting 26 is coupled to the back wall 17 of the housing, in the manner previously explained, and the housing is then attached to the wall 13 of the carton. To facilitate making this attachment the carton may be inverted and flaps forming the carton bottom swung out of the way. However attachment can also be made with the bottom of the carton remaining intact, and the flaps forming the top of the carton open to permit access. The housing is located generally in the region of the strip 14, and the tab 24 is first inserted through the accommodating slot 81, in the adjacent carton wall. Thereafter the side tabs 22 are inserted through the slots 82. To facilitate this operation the side walls of the housing are sprung towards each other, and after the tabs 22 have been inserted through the slots 82, the side walls are released to cause the tabs to lock the housing in the desired position. When the housing is in final position as shown in FIGS. 1—3, the edges of the housing are in abuting relation with the inner surface of the carton wall on an area surrounding the line of perforations 83. The tap at that time is completely within the housing as illustrated in FIG. 1. The sides of the valve body 36 may have sufficient frictional retention against the side walls of the housing, to retain the tap in this position. When assembled with the valve as shown in FIG. 11, the assembly appears as shown in FIGS. 13, 14 and 15.

Assuming for example that the invention is being used in the marketing of wine, the pouch may be filled with wine and sealed and thereafter the sealed fitting 26 can be coupled to the housing 12 and this assembly with the tap 16, inserted in the carton and the housing attached to one wall as previously described. However if desired the parts can be assembled within a carton before the pouch is filled with wine. In such event the pouch is filled through the open top of the carton, after which the pouch is sealed.

In general it will be evident that the invention has a number of desirable features. The complete package can be readily made by a winery or other establishment which is marketing liquid products. In the hands of a consumer it is only necessary to open the cover or break away strip 14, after which the valve end of the tap assembly can be manually engaged and swung outwardly with sufficient final force being applied to cause the membrane 64 to be opened by piercing and tearing. Also the two seals are successively established between the tap body and the fitting 26, and the tap eventually is locked in the dispensing position as shown in FIG. 3. Thereafter the strip 14 can be either discarded or may be swung back to cover the side wall opening into the housing. The tap remains in its locked position until the contents of the package are completely dispensed. Dispensing of liquid involves merely the raising and lowering of the strip 43. After closing no drippage occurs and air cannot enter the valve body. Assuming that the carton strip 14 is discarded or not positioned over the front of the housing, after the liquid level is below the top wall 19 of the housing, it can be seen by viewing the back wall through the front of the housing.

What is claimed is:

1. A tap assembly for dispensing liquid from a pouch having a dispensing fitting attached to one wall of the same, the fitting having a passage therethrough and an exterior annular portion extending from the wall of the pouch and terminating in an outer end, the fitting also having a sealing membrane serving to seal the passage, the tap assembly comprising a tubular body having an end portion adapted to be projected into the passage of the fitting to disrupt the membrane, a dispensing valve at the other end of the body, means forming a seal between the peripheral surface of said end portion of the body and the outer end of the fitting, and means for forming another seal between the outer end of said annular portion and the body, said last named means including an annular member surrounding and carried by said tubular body, said member being formed of pliable material shaped to form a socket recess dimensioned to embrace the said outer end of the annular portion of the fitting and to establish a seal between the outer end of the fitting and the tubular body when said end portion is thrust into the fitting to establish the first named seal and then to rupture the diaphragm, and is thereafter further advanced into the fitting to position the outer end of the fitting within the recess and in sealing engagement with said annular member.

2. A dispensing assembly for use with a carton having a flexible lining pouch, the pouch having a fitting formed of pliable material bonded to one wall of the same, the fitting having an exterior projecting annular portion and an opening therethrough, the fitting also having a sealing membrane at its inner end normally closing the opening, the membrane when disrupted permitting discharge of liquid from within the pouch through the opening, the assembly comprising means forming a separate housing, a dispensing tap normally accommodate within the housing, means for attaching the housing to one side wall of the carton near the bottom of the same with the interior of the housing and the fitting being accessible from the exterior of the carbon, the dispensing tap having an elongated tubular body provided with a portion at one end of the same formed to pierce the sealing membrane when introduced into the fitting and pressed against the membrane, a dispensing valve at the other end of the body, the body forming a passage for flow of liquid through the body to the valve, means for attaching the body of the tap to said housing for swinging movement of the tap between a normal position in which it is accommodated within the housing to a dispensing position wherein said one end of the tap is disposed within the opening of the fitting and the valve is disposed exterior of the housing and carton, means forming a seal between said one end portion of the tap body and the projecting annular portion of the fitting, movement of the tap to said dispensing position serving first to establish said seal between the end portion of the tap body and the inner peripheral surface of the projecting annular portion of the fitting, further movement of the tap serving to pierce the membrane and to establish another seal between said one end of the tap body and the fitting, said last named seal being formed by means including an annular member surrounding and carried by said one end of the tap body and formed to provide an open socket recess, the end of the projecting annular portion of the fitting being dimensioned to be seated within said socket recess to establish sealing engagement between the fitting and said body when the tap is moved axially to said dispensing position.

3. A dispensing assembly as in claim 2 in which the socket recess is tapered.

4. A dispensing assembly as in claim 2 in which the region of said second named seal when established generally surrounds the region of the first named seal.

5. A dispensing assembly as in claim 3 or 4 in which the fitting and the tap are so dimensioned and constructed that when the tap is swung to dispensing position, said first named seal is first established, the membrane is then pierced and then the second named seal is established by the annular socket forming member.

6. A dispensing assembly as in claim 2 in which said annular member is made of resilient material, and the socket recess formed by the annular member is tapered.

7. A tap construction for dispensing liquid from a liquid containing pouch, the pouch having a dispensing fitting secured to one wall of the same and having an opening through which liquid may flow, comprising an elongated tubular body having a flow passage through the same, a hollow valve body having one side of the same secured to one end of the tubular body and in communication with the passage, one end of the valve body, namely that end which is lower-most when the tap is in dispensing position, having a wall forming an annular valve seat, an annular valve member within the valve body and adapted to engage said seat, an operating stem extending through the valve body and having its lower end fixed to the valve member, means forming a closure for the upper end of the valve body, said closure means having an opening for accommodating the valve stem and formed to maintain a seal between the valve body and the valve stem, and operating means in the form of a strip for moving the stem and valve member from a lower closed position in which the valve member is in sealing engagement with the seat, to a position in which the valve member is raised from the seat to permit dispensing of liquid, the strip having two spaced slots, one slot being at an end of the strip, and the second slot located intermediate the ends of the strip and having a keyhole configuration, a member mounted on the tap body having a notch and dimensioned to be engaged by the slotted end of the strip to from a fulcrum attachment, the upper exterior end of the valve stem being dimensioned and formed to be engaged and retained within the second slot to form a fulcrum attachment.

8. A tap assembly for mounting on one wall of a carton which has an inner flexible liner capable of containing liquid to be disposed, the assembly comprising an elongated housing having an open front, a back wall and spaced side walls, the front edges of the side and bottom walls having means for attaching the same to said one wall of said carton, the side walls being so formed and of such material that they can be sprung apart, a tap dimensioned to be accommodated in the housing, the tap comprising an elongated tubular body and an arm fixed to the body, the arm having two aligned pivot pins on an axis at right angles to the axis of the body, pivot openings in the side walls near the back wall, and on an axis extending laterally of the length of the housing and parallel to the back wall, parallel guide tracks formed on the inner faces of the side walls extending from the front edges of the side walls to said pivot openings, said tracks being formed to guide the pivot pins into said pivot openings when the pins are engaged in said tracks at the open front of the housing and then manually traversed to the inner ends of the tracks with outward springing of the side walls.

* * * * *